US005501410A

United States Patent [19]

Starvaski

[11] Patent Number: 5,501,410

[45] Date of Patent: Mar. 26, 1996

[54] COIL REFORMING CHAMBER WITH AUXILIARY COIL PLATE

[75] Inventor: Raymond R. Starvaski, Worcester, Mass.

[73] Assignee: Morgan Construction Company, Worcester, Mass.

[21] Appl. No.: 379,943

[22] Filed: Jan. 27, 1995

[51] Int. Cl.[6] ..... B21C 47/10; B21C 47/24

[52] U.S. Cl. ..... 242/363; 242/361.5; 242/361.3; 140/2

[58] Field of Search ..... 242/363, 361.3, 242/361.4, 361.5; 140/1, 2

[56] References Cited

U.S. PATENT DOCUMENTS

Re. 25,477 11/1963 Crum ..... 242/361.4 X

FOREIGN PATENT DOCUMENTS 55-88928 7/1980 Japan ..... 242/363

*Primary Examiner*—John Q. Nguyen

*Attorney, Agent, or Firm*—Samuels, Gauthier & Stevens

[57] ABSTRACT

An auxiliary coil plate is mounted on and vertically adjustable with respect to the conventional elevator platform. The coil plate is designed to be raised into the coil forming chamber well above the level of the shear mechanism. By so doing, the ring free fall distance is beneficially reduced at an early stage in the coil formation cycle when the bottom most rings are being deployed.

10 Claims, 3 Drawing Sheets

COIL REFORMING CHAMBER WITH AUXILIARY COIL PLATE

BACKGROUND OF THE INVENTION

1. Field of the Invention

This invention relates generally to rod rolling mills where the hot rolled rod is formed into a continuous series of rings, and the rings are deposited in an overlapping pattern on a conveyor on which they are subjected to controlled cooling and/or heating. The invention is concerned in particular with an improvement in the reforming chambers employed at the delivery ends of the cooling conveyors to receive and gather the rings into coils.

2. Description of the Prior Art

In the conventional reforming chamber, the rings descend in a helical formation into a cylindrical enclosure. The rings alight on an elevator platform where they accumulate in coil form, usually around a central mandrel element. The platform is gradually lowered to compensate for the growing height of the coil.

The reforming chamber also typically includes a shear mechanism for subdividing billet lengths of rod into multiple coils, with associated intercepting devices for temporarily interrupting the descent of rings while an underlying coil is separated and cleared from the reforming chamber.

As the rings descend into the reforming chamber, care must be taken to see that they are properly and evenly distributed. Otherwise, the density, shape, and stability of the coil will be adversely affected. Experience has indicated that minimizing the height of ring free fall is critical to insuring controlled ring distribution.

In the past, the shear mechanisms have limited the extent to which the vertically adjustable elevator platforms can be elevated, with the result that ring free fall distance has been excessive, particularly in the early stages of each coil forming cycle.

The objective of the present invention is to achieve a marked decrease in the ring free fall distance, thereby making it possible to achieve significant improvements in coil density, shape and stability.

SUMMARY OF THE INVENTION

According to the invention, an auxiliary coil plate is mounted on and vertically adjustable with respect to the conventional elevator platform. The coil plate is designed to be raised into the coil forming chamber well above the level of the shear mechanism. By so doing, the ring free fall distance is beneficially reduced at an early stage in the coil formation cycle when the bottom most rings are being deployed.

Various mechanisms may be employed to vertically adjust the coil plate with respect to the elevator platform, with the preferred mechanism comprising multiple piston-cylinder units.

Other objects and advantages of the present invention will become more apparent as the description proceeds with reference to the accompanying drawings, wherein:

DESCRIPTION OF PREFERRED EMBODIMENT

Figure 1:
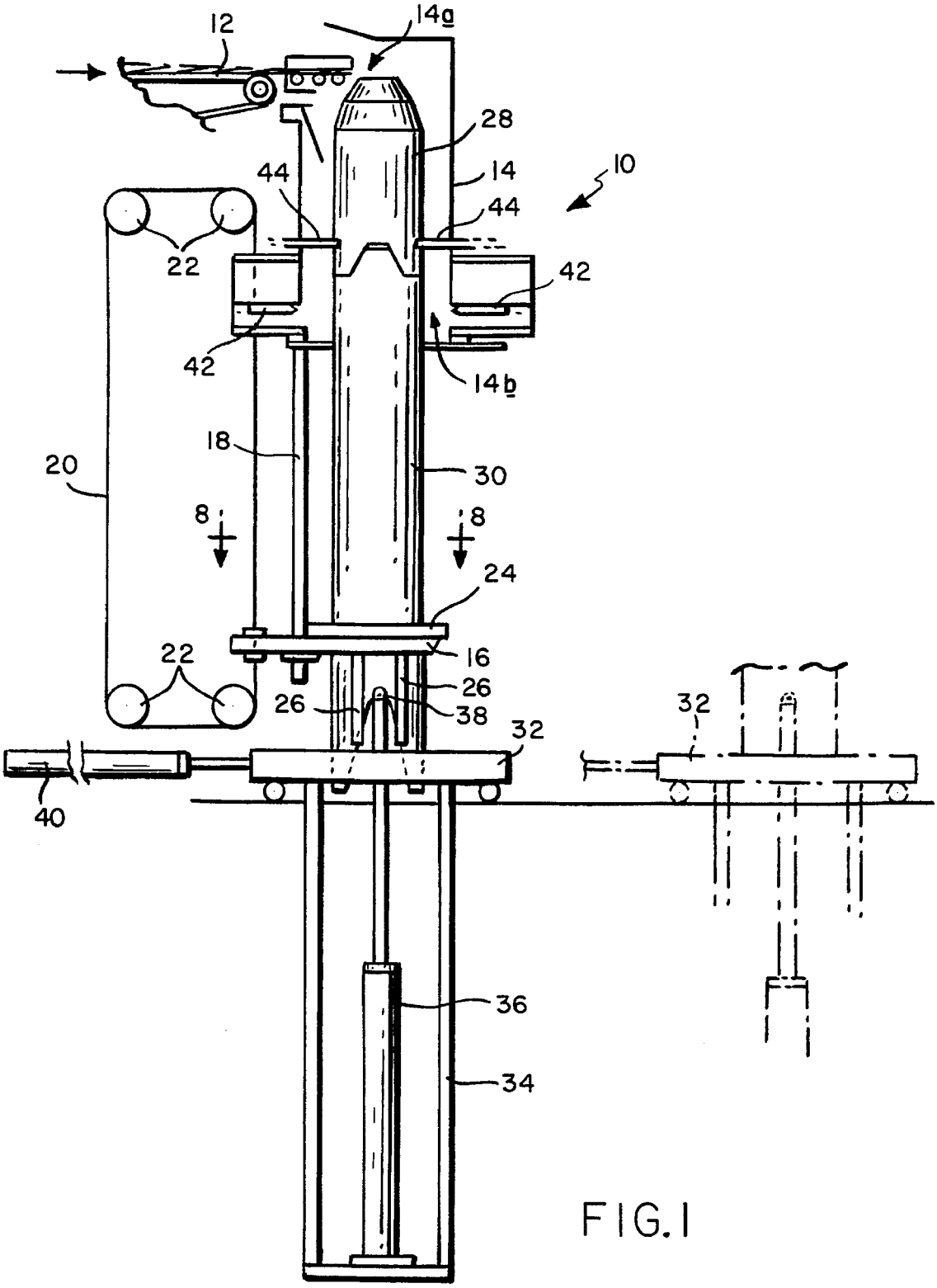
FIG. 1 is a view in side elevation of a reforming station embodying the concepts of the present invention.
Figure 8:
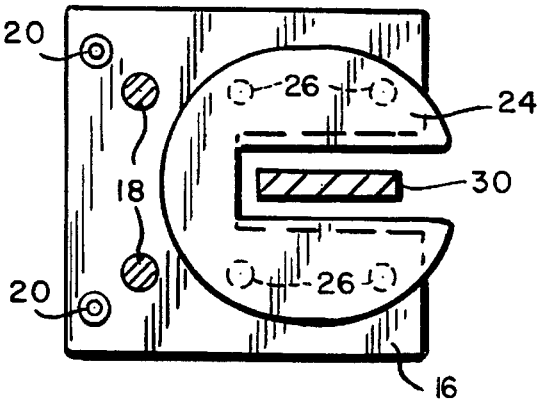
FIG. 8 is a sectional view taken along line 8—8 of FIG. 1.

With reference initially to FIGS. 1 and 8, a coil reforming station 10 is shown at the delivery end of a cooling conveyor 12. The reforming station includes a vertically disposed enclosure 14 having an open upper end 14a through which rings are received from the conveyor 12 to accumulate in coil form, and a lower open end 14b through which the thus accumulated coil may be withdrawn.

A generally horseshoe shaped elevator platform 16 underlies the lower end 14*b* of the enclosure. The elevator platform is guided for movement along vertical posts 18, and is raised and lowered by means of cables or chains 20 entrained around guide sheaves or sprockets 22, at least one of which is rotatably driven by conventional means (not shown).

A horseshoe shaped auxiliary coil plate 24 is carried by and vertically adjustable with respect to the elevator platform 16. Vertical adjustment of the coil plate may be achieved by various means, the preferred mode being multiple piston-cylinder units 26.

An upper mandrel element 28 commonly referred to as a "nose cone" is positioned centrally within the cylindrical enclosure 14. A lower mandrel element 30 commonly referred to as a "sail" underlies and is aligned axially with the nose cone 28. The sail 30 is mounted on and adjustable vertically with respect to a carriage 32. The carriage includes a depending support structure 34 on which is mounted a piston-cylinder unit 36 connected as at 38 to the sail. The carriage 32 is shiftable laterally to the position indicated by broken lines in FIG. 1 by means of a horizontally disposed piston-cylinder unit 40.

A shear mechanism 42 is located at the lower end of 14*b* the cylindrical enclosure 14, and ring intercepting elements 44 are spaced above the shear mechanism. As shown in FIG. 1, the ring intercepting elements have been adjusted to an operative positions protruding inwardly through the wall of the cylindrical enclosure into mechanical engagement with the nose cone 28. In its upper-most position as illustrated in FIG. 1, the sail provides the primary support for the nose cone 28, thereby freeing the ring intercepting elements 44 for retraction from the enclosure 14.

Figure 2:
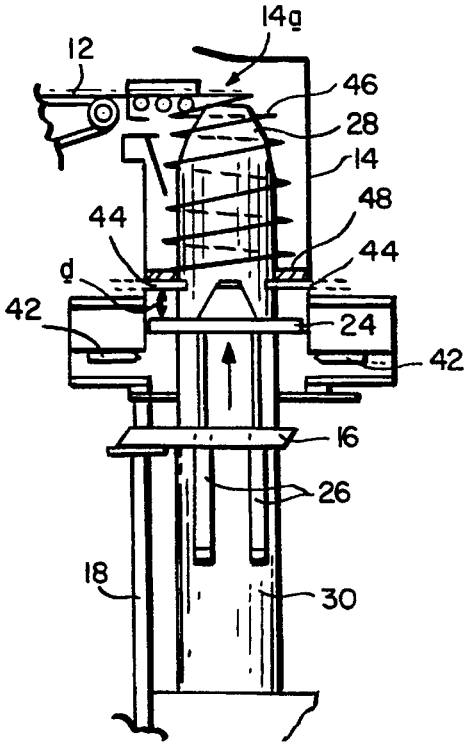
FIGS. 2–7 are views similar to FIG. 1 showing successive stages in a coil forming cycle.

A typical coil forming cycle will now be described with further reference to FIGS. 2–8. As shown in FIG. 2, rings 46 have begun to descend in a helical formation into the cylindrical enclosure 14 to accumulate around the nose cone 28 on the intercepting elements 44 in coil form as at 48. The elevator platform 16 has been raised to its uppermost position, and the auxiliary coil plate 24 has likewise been raised to its uppermost position well above the shear mechanism 42 and spaced below the ring intercepting elements 44 by a distance "d". When thus positioned, the auxiliary coil plate is directly beneath the nose cone 28.

Figure 3:
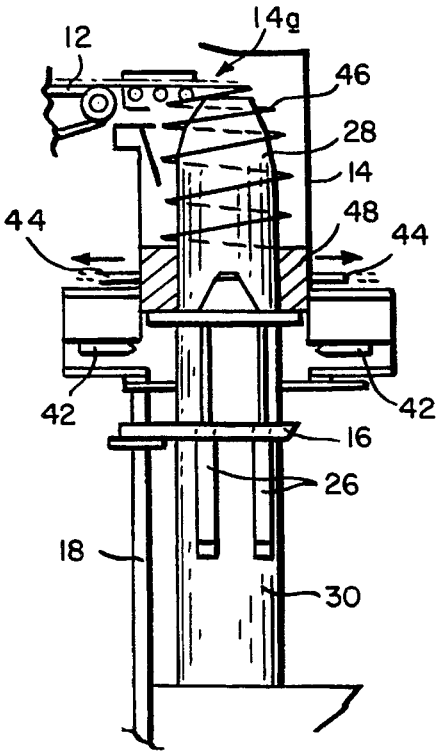

As illustrated in FIG. 3, at the appropriate interval in a coil formation cycle, the ring intercepting elements 44 are retracted from the cylindrical enclosure 14, thereby allowing the partially formed coil 48 to drop through the short distance "d" onto the elevated auxiliary coil plate 24. At this stage in the cycle, the nose cone 28 remains supported on the upper end of the sail 30.

Figure 4:
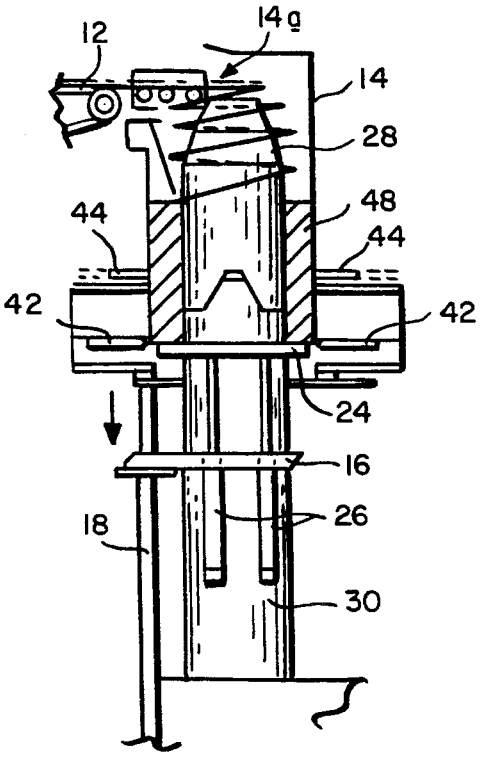

As shown in FIG. 4, coil formation continues as the elevator platform 16 is gradually lowered along with the extended auxiliary coil plate 24, thereby accommodating the gradually increasing coil height.

Figure 5:
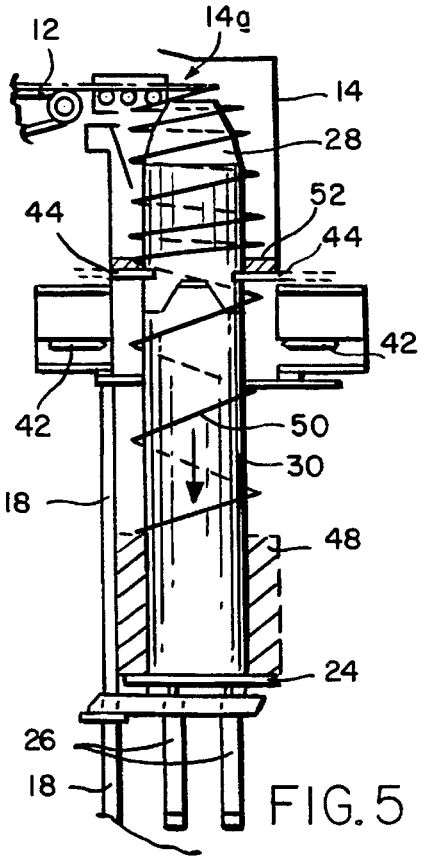

As shown in FIG. 5, when the coil 48 has reached the desired size, the ring intercepting elements 44 are again advanced into their operative positions in interengagement with the nose cone 28. The elevator platform 16 is brought to its lower most position, and the auxiliary coil plate 24 is also depressed. The fully formed coil 48 is thus at a lowered discharge level, and connected by means of a single strand 50 to rings continuing to accumulate as at 52 on the ring intercepting elements 44.

Figure 6:
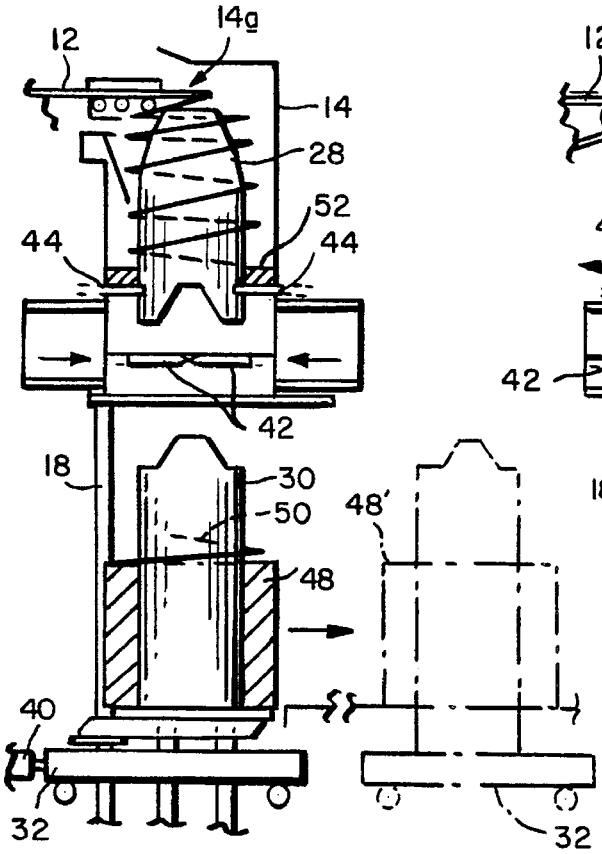

As shown in FIG. 6, the sail 30 is then axially retracted to an intermediate position beneath the operating range of the shear mechanism 42, and the shear mechanism is then actuated to severe the connecting strand 50. Once this has been accomplished, the piston cylinder unit 40 is actuated to laterally shift the carriage 32 together with the sail 30 and the completed coil 48 to the position shown by the broken lines in FIG. 6, with the coil now being discharged at 48'.

Figure 7:
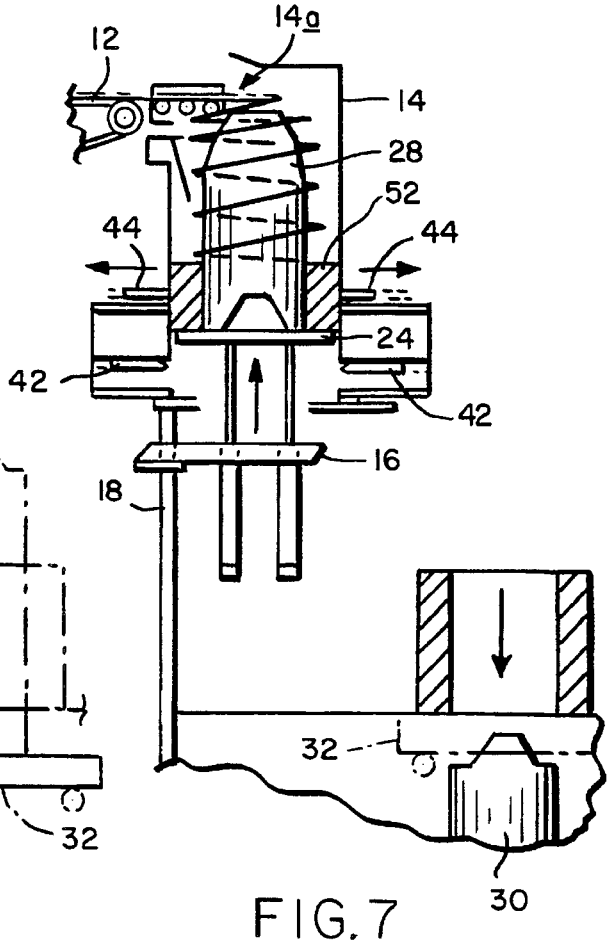

As shown in FIG. 7, the sail 30 is then fully retracted from the completed coil 48. Concurrently, the elevator platform 16 and the auxiliary coil plate 24 are returned to their uppermost positions with the nose cone 28 thus being supported on the auxiliary coil plate 24. The ring intercepting elements 44 then are retracted, thereby depositing the next gradually accumulating coil 52 on the auxiliary coil plate 24. The sail 30 is then returned to the position shown in FIG. 1, and the apparatus is thereafter sequentially cycled to produce the next coil.

It will be seen from the foregoing that by providing an auxiliary coil plate 24 which can be elevated up into the chamber 14 above the level of the shear mechanism 42, the free fall distance of rings accumulating on the interceptors 42 is reduced to a minimum distance "d", thereby largely avoiding disruption of optimum ring distribution at the base of the coil.

Various changes and modifications can be made to the above-described embodiment without departing from the scope of the appended claims. For example, the auxiliary coil plate 24 may be vertically adjusted with respect to the elevator platform 16 by means other than the piston-cylinder units 26, including for example screw jacks, scissor jacks, etc. Other mechanisms also may be employed to vertically adjust the elevator platform 16, and to laterally shift the carriage 32.

I claim:

1. Apparatus for gathering a descending helical formation of rings into an upstanding annular coil, said apparatus comprising:

a vertically disposed enclosure having an upper end through which said rings are received to accumulate in coil form within said enclosure, and a lower end through which an accumulated coil may be withdrawn;

an elevator platform underlying said enclosure;

first operating means for vertically adjusting the position of said elevator platform between an upper position adjacent to but spaced beneath the lower end of said enclosure, and a lower position spaced beneath said upper position; a coil plate carried by said elevator platform;

second operating means for vertically adjusting the position of said coil plate relative to said elevator platform between an upper level protruding upwardly into said enclosure when said elevator platform is at said upper position, and a lower discharge level spaced beneath said upper level when said elevator platform is at said lower position;

whereupon a coil being formed within said enclosure may be received on said coil plate at said upper level and removed from said coil plate at said discharge level.

2. The apparatus as claimed in claim 1 further comprising an upper mandrel element arranged centrally within said enclosure, and about which said rings accumulate in coil form.

3. The apparatus as claimed in claim 2 wherein said upper mandrel element is engaged by and vertically supported on said coil plate when said coil plate is at said upper level.

4. The apparatus as claimed in claim 1 further comprising a lower mandrel element arranged below and aligned with said upper mandrel element, and second operating means for axially adjusting the position of said lower mandrel element between a raised position engaging and vertically supporting said upper mandrel element, and a lowered position beneath said discharge level.

5. The apparatus as claimed in claim 4 wherein said lower mandrel element is adjustable to an intermediate position between said raised and lowered positions, and wherein said apparatus further comprises third operating means for laterally shifting the thus intermediately positioned lower mandrel element to remove said coil from said coil plate at said discharge level.

6. The apparatus as claimed in claim 1 further comprising arresting means for temporarily supporting said rings within said enclosure at a level above said upper level.

7. The apparatus as claimed in claim 6 wherein said arresting means comprises a plurality of support members positionally adjustable between respective inoperative positions withdrawn from said enclosure and operative positions protruding into said enclosure.

8. The apparatus as claimed in claim 7 wherein said operatively positioned support members engage and vertically support said upper mandrel element.

9. The apparatus as claimed in claim 6 wherein the rings temporarily supported on said arresting means are connected to an underlying coil by a strand, said apparatus further comprising shear means for severing said strand.

10. The apparatus as claimed in claim 9 wherein said shear means is positioned at a level above the upper position of said elevator platform but below the upper level of said coil plate.

* * * * *